United States Patent [19]

Gautraud

[11] Patent Number: 4,787,634

[45] Date of Patent: Nov. 29, 1988

[54] METHOD OF PLAYING A BOWLING GAME

[75] Inventor: Michael G. Gautraud, Muskegon, Mich.

[73] Assignee: Brunswick Corporation, Muskegon, Mich.

[21] Appl. No.: 118,249

[22] Filed: Nov. 9, 1987

[51] Int. Cl.[4] ..... A63D 5/00

[52] U.S. Cl. ..... 273/37; 273/54 C

[58] Field of Search ..... 273/37, 54 R, 54 C, 273/54 D

[56] References Cited

U.S. PATENT DOCUMENTS 3,153,538 10/1964 Rogers ..... 273/43 D
3,212,780 10/1965 Jewell ..... 273/54 C
3,529,824 9/1970 Walch ..... 273/54 R
4,597,575 7/1986 Kosof ..... 273/37

FOREIGN PATENT DOCUMENTS 809541 4/1969 Canada ..... 273/54 C

*Primary Examiner*—Anton O. Oechsle
*Attorney, Agent, or Firm*—Wood, Dalton, Phillips, Mason & Rowe

[57] ABSTRACT

A method of playing a bowling game in which players are allowed a preselected number of balls to knock down all pins in each of a plurality of frames. Each player is required to deliver at least one ball in each of the frames. The number of pins knocked down by each player in each frame is counted, with strikes recorded for all pins being knocked down by a first ball and spares recorded for all pins being knocked by a second ball. A player is allowed to change the pin setup after delivering the first ball and before delivering the second ball. The player's changed pin setup can be randomly selected. Thereafter, the frame scores and game scores are determined as in a conventional bowling game.

13 Claims, 1 Drawing Sheet

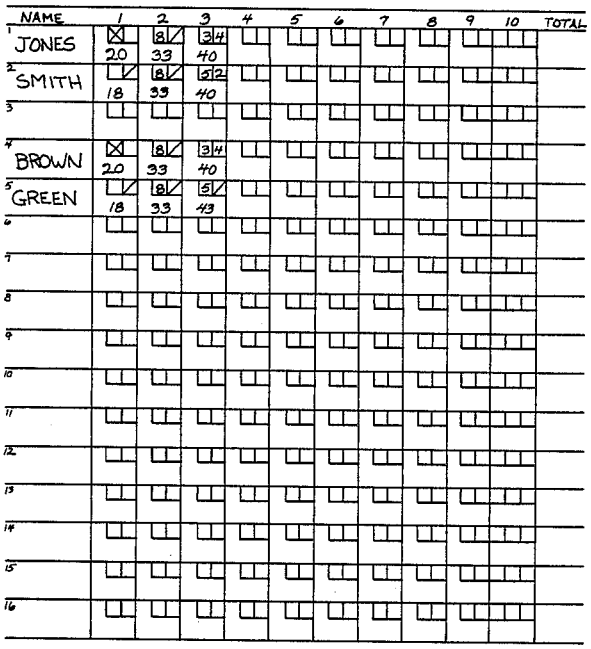

| NAME | 1 | 2 | 3 | 4 | 5 | 6 | 7 | 8 | 9 | 10 | TOTAL |
|---|---|---|---|---|---|---|---|---|---|---|---|
| 1 JONES | ☒ 20 | 8/ 33 | 34 40 | | | | | | | | |
| 2 SMITH | / 18 | 8/ 33 | 52 40 | | | | | | | | |
| 3 | | | | | | | | | | | |
| 4 BROWN | ☒ 20 | 8/ 33 | 34 40 | | | | | | | | |
| 5 GREEN | / 18 | 8/ 33 | 5/ 43 | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

METHOD OF PLAYING A BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. There is a definite need for new methods of playing a bowling game which are more exciting during the entire play of the game; for games which are challenging but not difficult; and for games to increase and enhance the public interest in the sport. This invention is directed to satisfying these needs and to rectifying lack of interest problems in the conventional method of playing a bowling game.

SUMMARY OF THE INVENTION

Accordingly, an object of the invention is to provide a new method of playing a bowling game in which players are allowed a preselected number of balls to knock down all pins in each of a plurality of frames.

According to the method of this invention, each player is required to deliver at least one ball in each of the frames. The number of pins knocked down by each player in each frame is counted, with strikes recorded for all pins being knocked down by a first ball and spares recorded for all pins being knocked down by a second ball. Each player in each frame is allowed to change the pin setup after delivering the first ball but before delivering the second ball. This preferably is done by a random selection. Each player's frame score is recorded and determined by adding the number of pins knocked down by the respective player on the next two balls if a strike was recorded in the previous frame, the number of pins knocked down by the respective player on the next one ball if a spare was recorded in the previous frame, and only the number of pins knocked down if pins remained standing after two balls in the previous frame. Each player's frame scores are added to determine the player's total score for the game, and the players' game scores are compared to determine the winner of the game.

Other objects, features and advantages of the invention will be apparent from the following detailed description taken in connection with the accompanying drawing.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawing showing a simulated score sheet which might be used in playing the bowling game of this invention.

DETAILED DESCRIPTION OF THE PREFERRED EMBODIMENT

With the method of playing a bowling game according to the invention, generally players are allowed a preselected number of balls to knock down all pins in each of a plurality of frames. Each player is required to deliver at least one ball in each of the frames. As in a conventional bowling game, the number of pins knocked down by each player in each frame is counted, with strikes recorded for all pins being knocked down by a first ball and spares recorded for all pins being knocked down by a second ball.

However, the unique method of playing the bowling game in accordance with the concepts of this invention adds an interesting element of allowing each player to change the pin setup before delivering the second ball. In other words, if a player delivers his first ball and fails to knock down all of the pins in the respective frame, i.e. the player does not achieve a "strike", the player is left with a "spare" opportunity of a pin setup consisting of the pins remaining standing after the first ball. This pin setup can be changed by the player after delivering the first ball so that the player has an opportunity to deliver the second ball at a differing pin setup in an attempt to score a spare. Preferably, the player is allowed to change his "spare" pin setup only once in each frame. In addition, the initial pin setup in each frame preferably is a full ten-pin setup.

Although the method of playing the bowling game could incorporate a procedure by which a player could arbitrarily select a different "leave" at which he can deliver his second ball, such as a differing pin setup of an equal number of pins which the player left after delivering his first ball, a much more interesting method of playing the game is contemplated by each player's changed pin setup being randomly selected. This random selection can be performed in various ways, such as manually by using index cards or by a computerized system. For instance, the selection of a random pin setup could include limiting the "changed" pin setup to an equal number of pins as the respective "leave" of the player in that frame, or the changed pin setup could be a completely different setup of more or less pins than the player left after delivering his first ball. The random method of playing the game adds the element. of chance to the game and further stimulates the interest and fun of the players.

For instance, a player may be left with a 6-7 pin split which is a relatively difficult pin setup in order to knock down both the "6" and "7" pins. If the game is designed such that the changed pin setup is of an equal number of pins, a player might be presented with a changed pin setup of the "1" and "2" pins which would be a much easier leave. On the other hand, the player might be presented with a changed pin setup of the "7" and "10" pins which would be even a more difficult leave. It can be seen how the element of chance enters the game. Alternatively, as stated above, the method of playing the game might involve the changed pin setup being of any number of pins. In other words, the situation described above may end up with the player changing his "6-7" leave to a "2-4-5" leave.

After the respective player either changes or does not change his pin setup after delivering his first ball, the player proceeds to deliver his second ball and each player's frame score is recorded as in a conventional bowling game. In other words, the number of pins knocked down by each player on the next two balls is added to the previous frame if a strike was recorded in the previous frame. The number of pins knocked down by a respective player on the next one ball is added to the previous frame if a spare was recorded in the previous frame. Only the number of pins knocked down are recorded in any given frame if pins remained standing after two balls in the previous frame.

Each player's frame scores then are added to determine the player's total score for the game. The players' game scores are compared to determine the winner of the game.

The FIGURE of the drawing simply shows a conventional bowling game score sheet indicating a twosome of "Jones" and "Smith" playing a bowling game. In the first frame, Jones scores a strike on his first ball and the strike is recorded in his column under the first frame, as is conventional. Smith scores a spare in the first frame and the spare is recorded in conventional fashion, as indicated.

In the second frame, Jones knocked down eight pins with his first ball and cleared the remaining two pins on his second ball, resulting in a spare and a score as indicated. Therefore, all ten pins knocked down by Jones in the second frame are added to the ten pins in the first frame, resulting in a score of "20", as shown. Similarly, Smith knocked down eight pins with his first ball and cleared the other two pins with his second ball, resulting in a spare in the second frame. Since Smith scored a spare in the first frame, only the eight pins knocked down by Smith with his first ball in the second frame is added to the first frame, resulting in a score of "18", as shown.

In the third frame, Jones knocked down three pins with his first ball and four pins with his second ball, resulting in a score of "7" for the third frame. Since Jones scored a spare in the second frame, the three pins in the third frame is added to the second frame resulting in "13" being added to the score of the first frame to arrive at the running score of "33" through the second frame, with only the seven pins knocked down in the third frame being added for a cumulative score after three frames of "40".

Smith, in the third frame, knocked down five pins with his first ball which is added to the second frame since Smith scored a spare in the second frame, resulting in "15" being added to his score of the first frame and a score of "33" after the second frame, the same as Jones. Smith knocked down only two pins with this second ball in the third frame and, therefore, only the seven pins are added to the running score, resulting in a score of "40" for Smith after three frames. Jones and Smith are tied after three frames even though Jones scored a strike in the first frame. This conventional scoring is carried on through all frames of the game and, as stated above, each player's frame scores are added to determine the player's total score for the game, and the players' game scores are compared to determine the winner of the game.

However, during the entire course of the game, both Jones and Smith are allowed to change the pin setup before delivering their second ball. In other words, each player's "leave" can be changed after delivering his respective first ball in each frame in order to present a different pin setup for attempting to achieve a "spare".

For instance, assume that "Brown" and "Green" were playing a game and, as shown on the score sheet of the FIGURE, Brown achieves the same scores as Jones, described above. In the first two frames, Green achieves the same scores as Smith, described above, through the first two frames. Like Smith, Green knocked down five pins with his first ball in the third frame. Assume Smith was left with a "2-4-7-8-10" pin leave. Green decides to change this rather difficult pin setup and ends up with a "2-4-5-7-8" leave which is a much easier pin setup. Green proceeds to deliver his second ball and knocks down all of the five pins, resulting in a spare and a frame score of "10" and a running score of "43" through the first three frames. Of course, it should be understood that the method of playing the bowling game according to the invention contemplates allowing each player in each frame to change the pin setup before delivering his second ball. The above scenario has been given simply to exemplify the potential impact on the game scoring by the new sequence of steps and method of playing the bowling game according to the invention.

In order to add still more excitement to the game, a player may be limited in the number of times he can change the pin setup during an entire game. For instance, in a ten frame game, each player may be allowed to change the pin setups only five times. This would require a player to exercise some judgment and "save" some of his changes in the event of a later, very difficult leave. Alternatively, players may be allowed only a predetermined number of changes in a game as determined by their average, handicap or other predetermined criteria.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of playing a bowling game in which players are allowed to knock down all pins in each of a plurality of frames, said method comprising:

(a) requiring each player to deliver at least one ball in each of said frames;

(b) counting the number of pins knocked down by each player in each frame, with strikes recorded for all pins being knocked down by a first ball and spares recorded for all pins being knocked down by a second ball;

(c) allowing a player to change the pin setup before delivering the second ball;

(d) recording each player's frame score as determined by adding the number of pins knocked down by the respective player on the next two balls if a strike was recorded in the previous frame, the number of pins knocked down by the respective player on the next one ball if a spare was recorded in the previous frame, and only the number of pins knocked down if pins remained standing after two balls in the previous frame;

(e) adding each player's frame scores to determine said player's total score for the game; and (f) comparing the players' game scores to determine the winner of the game.

2. The method of claim 1 wherein each of said plurality of frames is started with a full ten pin setup.

3. The method of claim 1 wherein the player is allowed to change the pin setup only once in each frame.

4. The method of claim 1 wherein the player's changed pin setup is randomly selected.

5. The method of claim 4 wherein the player is allowed to change the pin setup only once in each frame.

6. The method of claim 1 wherein the changed pin setup of the player includes the same number of pins left by the player in a respective frame after delivering the first ball.

7. The method of claim 1 wherein a player is allowed only a limited number, less than said plurality of frames, of changed pin setups throughout a game.

8. A method of playing a bowling game in which players are allowed a preselected number of balls to knock down all pins in each of a plurality of full ten pin setup frames, said method comprising:

(a) requiring each player to deliver at least one ball with a maximum of two balls in each of said full pin setup frames;

(b) counting the number of pins knocked down by each player in each frame, with strikes recorded for all pins being knocked down by a first ball and spares recorded for all pins being knocked down by a second ball;

(c) allowing a player a single opportunity in at least some of the frames to change the pin setup after delivering a first ball and before delivering a second ball;

(d) recording each player's frame score as determined by adding the number of pins knocked down by the respective player on the next two balls if a strike was recorded in the previous frame, the number of pins knocked down by the respective player on the next one ball if a spare was recorded in the previous frame, and only the number of pins knocked down if pins remained standing after two balls in the previous frame;

(e) adding each player's frame scores to determine said player's total score for the game; and (f) comparing the players' game scores to determine the winner of the game.

9. The method of claim 8 wherein the player's changed pin setup is randomly selected.

10. The method of claim 9 wherein said randomly selected changed pin setup includes the same number of pins left by the player in a respective frame after delivering the first ball.

11. The method of claim 9 wherein said randomly selected changed pin setup can include a differing number of pins.

12. The method of claim 8 wherein a player is allowed only a limited number, less than said plurality of frames, of changed pin setups throughout a game.

13. The method of claim 12 wherein said limited number is predetermined and based on each player's handicap.

* * * * *